US005373862A

United States Patent [19]

Blachut

[11] Patent Number: 5,373,862

[45] Date of Patent: Dec. 20, 1994

[54] COSMETIC CASE WITH INTERCHANGEABLE INSERTS

[75] Inventor: Longin Blachut, Genéve, Switzerland

[73] Assignee: AG Hevco, Zug, Switzerland

[21] Appl. No.: 898,444

[22] Filed: Jun. 15, 1992

[30] Foreign Application Priority Data

Jun. 21, 1991 [DE] Germany ..... 9107684[U]
Apr. 12, 1992 [DE] Germany ..... 9203350[U]

[51] Int. Cl.[5] ..... A45D 33/24

[52] U.S. Cl. ..... 132/294; 132/315; 206/581; 206/823

[58] Field of Search ..... 132/294, 295, 296, 301, 132/303, 304, 305, 314, 315; 206/477, 480, 483, 581, 823

[56] References Cited

U.S. PATENT DOCUMENTS

| | | | |
|---|---|---|---|
| 1,409,867 | 3/1922 | Kendall | 132/294 |
| 1,438,835 | 12/1922 | Kendall | 132/294 |
| 1,440,876 | 1/1923 | Kendall . | |
| 1,467,764 | 9/1923 | Lyhne | 132/301 |
| 1,623,994 | 4/1927 | Buchsbaum et al. | 132/304 |
| 1,818,409 | 8/1931 | Leberman | 132/301 |
| 1,835,951 | 12/1931 | Kendall . | |
| 1,883,793 | 10/1932 | Johnson | 132/300 |
| 2,035,832 | 3/1936 | Parkin | 132/300 |
| 2,078,096 | 4/1937 | Parkin | 132/301 |
| 2,179,669 | 11/1939 | Parkin | 132/315 |
| 2,866,467 | 12/1958 | Bradford | 132/82 |
| 3,911,936 | 10/1975 | Kingsford | 132/301 |
| 4,538,725 | 9/1985 | Glover et al. | 132/294 |
| 4,589,430 | 5/1986 | Sussman | 132/294 |
| 4,863,034 | 9/1989 | Contreas, Jr. | 132/294 |
| 5,092,354 | 3/1992 | Pacelli, Jr. | 132/294 |

FOREIGN PATENT DOCUMENTS 3809241 9/1989 Germany .

*Primary Examiner*—Gene Mancene
*Assistant Examiner*—Frank A. LaViola
*Attorney, Agent, or Firm*—Kenyon & Kenyon

[57] ABSTRACT

The cosmetic case for receiving and holding at least one insert comprising a snap-in locking mechanism between the case housing and each insert, said snap-in locking mechanism comprising at least one recess in the inside of the case housing and projections on the outside of the insert or vice versa; the projections and the recesses can be engaged with one another. Furthermore, the snap-in locking mechanism comprises at least one elastic element to preload the projections into the opposing recesses. The elastic element may be formed by leaf springs. This cosmetic case is simple and inexpensive to produce and allows a film and releasable connection between the case and the insert even after repeated removal of the inserts.

8 Claims, 3 Drawing Sheets

FIG. 5
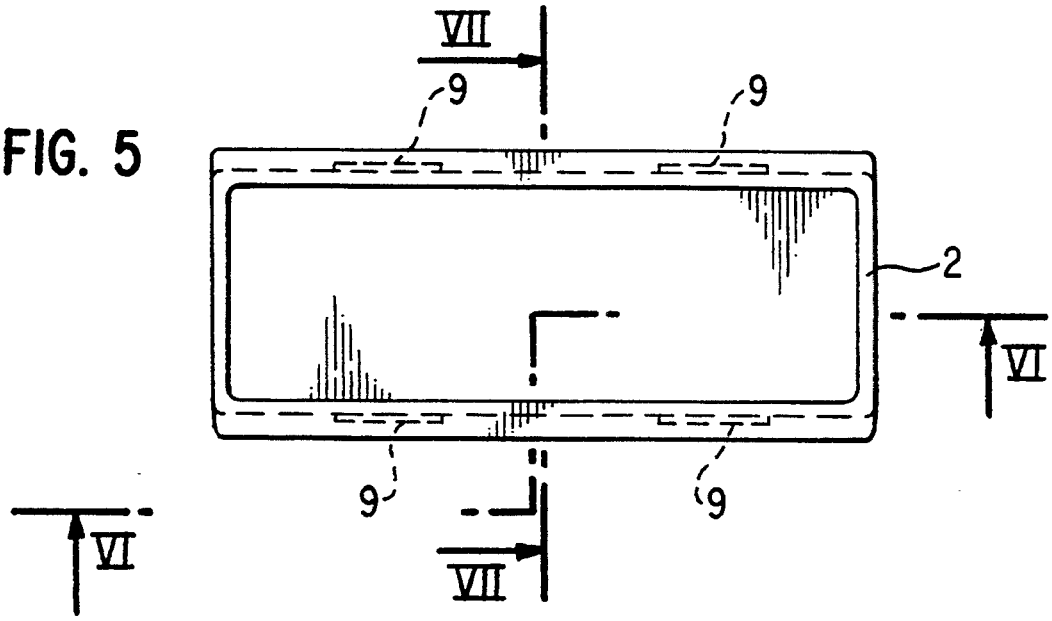
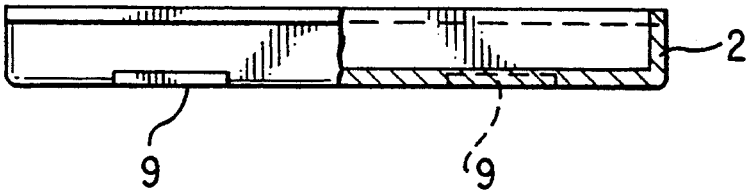
FIG. 6
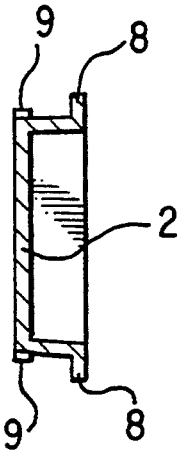
FIG. 7

COSMETIC CASE WITH INTERCHANGEABLE INSERTS

The invention relates to a cosmetic case with inserts. The inserts can contain cosmetics such as powder, make-up or colors and can be combined in the cosmetic case to any interchangeable set of cosmetics.

In conventional cosmetic cases the individual inserts are fixed in the cosmetic case. If the contents of one or more inserts are used up, the whole case has to be replaced.

In EP-B 081 901 a Cosmetic case is described in which several inserts are arranged on the bottom such that they can be interchanged, whereby the underside of each insert is provided with a magnet and the inner surface of the base of the case is provided with a magnetic material so that the inserts are held on the magnetic material by the magnets.

Such cosmetic cases consist, however, of at least three different materials: the material of which the cosmetic case and the inserts are made, the magnets on the underside of the inserts and the magnetic material of the inner surface of the base. Such magnets and magnetic materials are expensive. Furthermore, the production of such cosmetic cases is complicated because of the use of different materials and is therefore likewise expensive.

Cosmetic cases are further known wherein the inserts are clamped by frictional engagement. Repeated removal and insertion of the inserts can decrease frictional engagement due to a change in shape so that the inserts are no longer held sufficiently firmly in place.

The object underlying the present invention is to provide a cosmetic case which is simple and inexpensive to produce and which ensures a firm and releasable connection between the case and the insert even when it is used for longer periods.

This object is achieved with the cosmetic case according to the claims.

The invention is based on the idea of ensuring that the insert is held in the cosmetic case by positively locking it in a suitable way preferably supported by an elastic locking element.

The invention is illustrated in more detail with reference to the drawings.

FIG. 5 shows a top view onto the insert;

FIG. 6 shows a side view along VI—VI in FIG. 5 of the insert;

FIG. 7 shows a cross section along VII—VII in FIG. 5;

Figure 1:
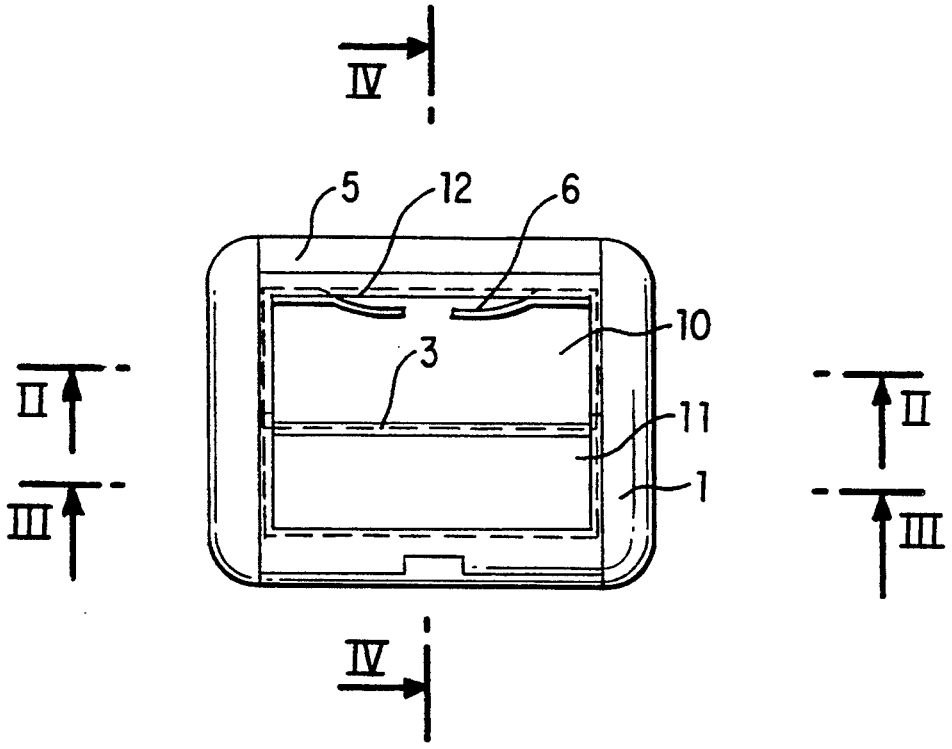
FIG. 1 shows a top view of a cosmetic case according to the present invention wherein the lid is not shown in order to simplify the illustration.
Figure 2:
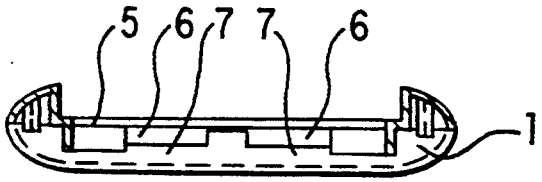
FIG. 2 shows a cross section along II—II in FIG. 1.
Figure 3:
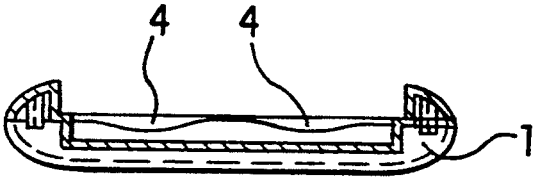
FIG. 3 shows a cross section along III—III in FIG. 1.

The cosmetic case has a flat rectangular external form and consists of a housing 1 and a housing lid which is not shown. The housing 1 is in the form of a flat tray which for example is divided longitudinally by a ridge 3 into a front compartment 11 and a rear compartment 10. The ridge 3 has two engagement means 4. The rear wall 5 of the tray has two elastic elements 6. The ridge 3 and the elastic elements 6 do not close flush with the inner base of the housing but leave recesses 7.

The insert 2 is likewise in the form of a rectangular tray with projecting upper edges 8 extending along its lengths. On the outside of the insert 2 four projections 9 are provided which close flush with the base and engage with the recesses 7 when the insert is inserted into the cosmetic case. When inserting the insert into the cosmetic case, the projections 9 arranged on one side of the insert 2 firstly engage with the recesses 7 beneath the elastic elements 6 against the pressure of the elastic elements 6; the insert 2 is subsequently pressed on the side facing the ridge 3 into the rear compartment 10 so that the corresponding projections 9 engage with the recesses 7 in the ridge 3. In so doing, the elastic elements 6 in FIG. 1 move upwards into recesses 12 of the housing. The elastic elements 6 press the projections 9 arranged on the other side of the insert 2 into the recesses 7 beneath the ridge 3. Both edges of the insert 2 come to rest on the ridge 3 and the elastic elements 6.

Figure 4:
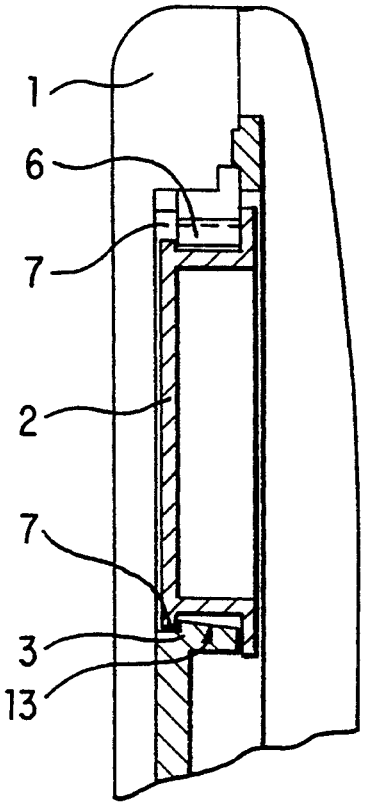
FIG. 4 shows a cross section along IV—IV in FIG. 1 with the inserted insert.
Figure 8:
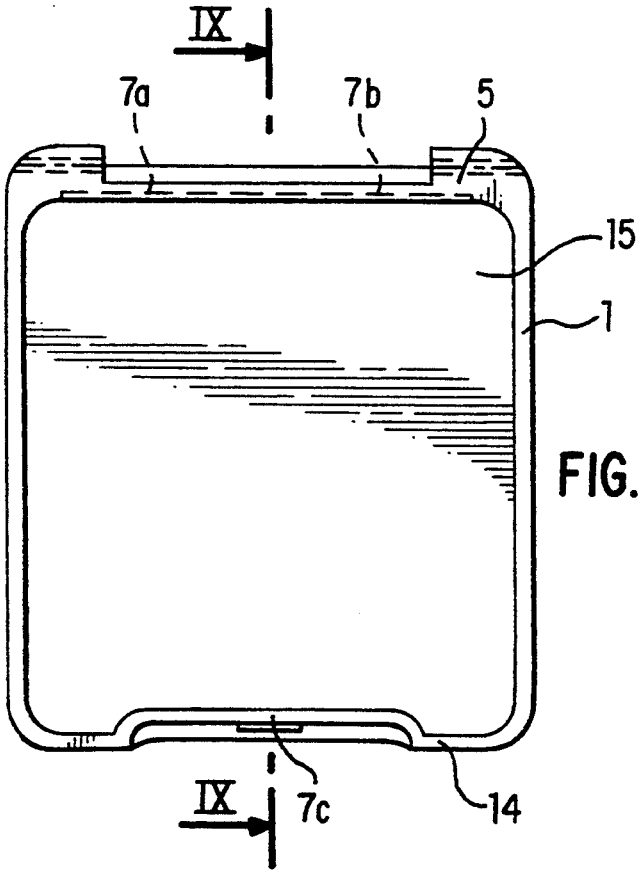
FIG. 8 shows a top view of the cosmetic case according to the present invention wherein the lid is not shown in order to simplify the illustration.
Figure 9:
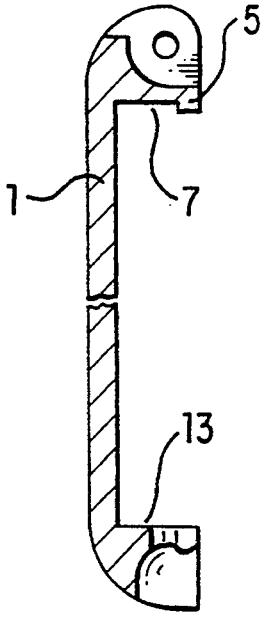
FIG. 9 shows a cross section along IX—IX in FIG. 8.
Figure 10:
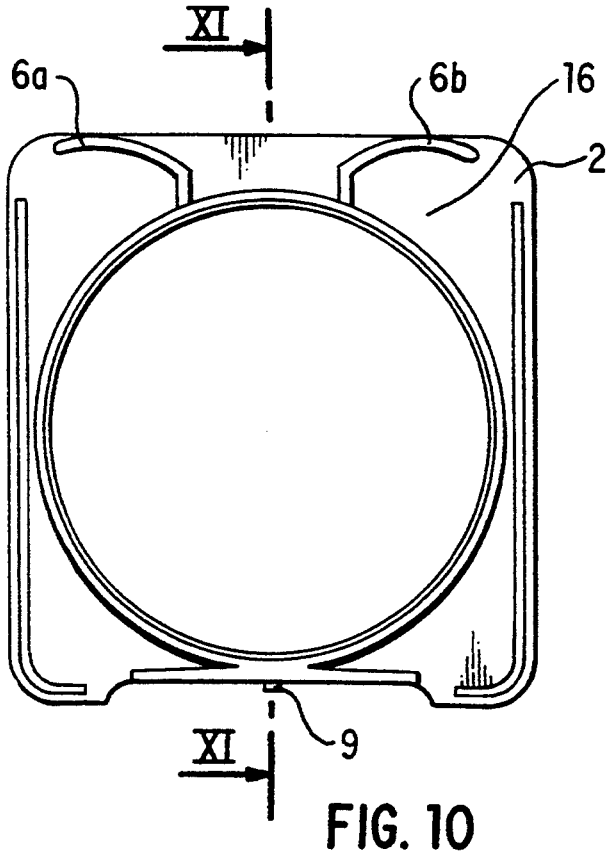
FIG. 10 shows a bottom view of an insert.
Figure 11:
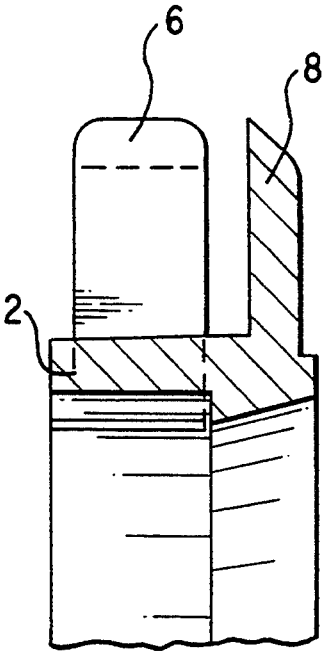
FIG. 11 shows an enlarged view of a partial section of the insert along XI—XI in FIG. 10.

To remove the insert from the housing, it is possible to take hold of the insert 2 beneath its edge 8 supported by the engagement means 4 and push the insert against the elastic elements 6; this disengages the projections 9 from the recesses 7 in the ridge 3 and the insert 2 can be lifted out of the rear compartment 10. This makes it very easy to insert an insert 2 into the cosmetic case and to replace it with a different insert 2. In order to make it even easier to insert the insert, the side 13 of the ridge 3 facing the insert 2 can be slightly slanted (see FIG. 4).

The base of the front compartment 11 is slightly raised compared with the rear compartment 10. The front compartment 11 can hold make-up utensils such as brushes etc.

In the embodiments according to FIGS. 8 to 11, the cosmetic case has a flat rectangular external form and consists of a housing 1 and a housing lid which is not shown. The housing 1 is in the form of a flat tray. The rear wall 5 of the tray has two recesses *7a* and *7b*. The front wall 14 has a further recess *7c*.

The insert 2 is likewise in the form of a rectangular tray with projecting upper edges 8. On the outside of the insert 2 two elastic elements *6a* and *6b* and on the opposing side a projection 9 is provided which engage with the recesses *7a*, *7b* and *7c* respectively when the insert is inserted into the cosmetic case. When inserting the insert into the cosmetic case, the elastic elements *6a* and *6b* arranged on the one side of the insert 2 engage with the recesses *7a* and *7b* in the rear wall 5 of the housing 1; the insert 2 is subsequently pressed on the side facing the front wall 14 into the compartment 15 so that the corresponding projection engages with the recess *7c* in the front wall 14. In so doing, the elastic elements *6a* and *6b* in FIG. 10 move downwards into recesses 16 of the insert. The elastic elements *6a* and *6b* press the projection 9 arranged on the other side of the insert 2 into the recess *7c* in the front wall 14. The edges of the insert 2 come to rest on the edges of the housing 1.

To remove the insert from the housing, it is possible - optionally supported by engagement means which are not shown - to take hold of the insert 2 beneath its edge 8 and to press the insert against the elastic elements *6a* and *6b*; this disengages the projection 9 from the recess *7c* in the front wall 14 and the insert 2 can be lifted out of the compartment 15. This makes it very easy to insert an insert 2 into the cosmetic case and to replace it with a different insert 2. In order to make it even easier to insert the insert, the side 13 of the front wall 14 facing the insert 2 can be slightly slanted (see FIG. 9).

In the above, the use of only one insert 2 has been explained. However, several e.g. two inserts can be inserted next to one another into the compartment 10 or 15, whereby at least one elastic element for each insert is provided. In the scope of the present invention, the cosmetic case can also comprise several compartments 10 or 15, each of which is for one or several inserts 2.

The integral design, e.g. out of plastic, and the integral shaping of the elastic elements to the cosmetic case or to the insert make production easier since there is only one single operation.

I claim:

1. A cosmetic case comprising:

a) a housing being in the form of a flat tray, having an inner base, a front wall and a rear wall;

b) an elastic element being disposed on the rear wall of the housing;

c) a recess being disposed between the inner base of the housing and the elastic element on the rear wall;

d) a notch being disposed at a base of the front wall;

e) an insert being in the form of a rectangular tray and having a base;

f) a first projection being disposed on the exterior of the insert on a side facing the notch, and being disposed at the base of the insert, whereby said first projection engages with the notch when the insert is inserted into the housing, and said elastic element presses the first projection into the notch; and g) a second projection being disposed on the exterior of the insert on a side facing the recess, and being disposed at the base of the insert, whereby said second projection engages with the recess and below a point at which the elastic element presses against the insert when the insert is inserted into the housing.

2. The cosmetic case according to claim 1, further comprising:

a) an engagement means being disposed on a top surface of the front wall; and b) a projecting upper edge being disposed on the insert and extending along a length of the rectangular tray, wherein said projecting edge engages with the engagement means on the front wall to support said insert in said housing.

3. The cosmetic case according to claim 1, further comprising a ridge with a slanted side facing the insert.

4. A cosmetic case comprising:

a) a housing being in the form of a flat tray, having an inner base, and a rear wall;

b) a ridge being disposed in said housing, and dividing said housing longitudinally into a front compartment and a rear compartment.

c) an elastic element being disposed on the rear wall of the housing;

d) a recess being disposed between the inner base of the housing and the elastic element on the rear wall;

e) a notch being disposed at a base of the ridge;

f) an insert being in the form of a rectangular tray and having a base;

g) a first projection being disposed on the exterior of the insert on a side facing the notch, and being disposed at the base of the insert, whereby said first projection engages with the notch when the insert is inserted into the housing, and said elastic element presses the first projection into the notch; and h) a second projection being disposed on the exterior of the insert on a side facing the recess, and being disposed at the base of the insert, whereby said second projection engages with the recess and below a point at which the elastic element presses against the insert when the insert is inserted into the housing.

5. The cosmetic case according to claim 4, further comprising:

a) an engagement means being disposed on a top surface of the ridge; and b) a projecting upper edge being disposed on the insert and extending along a length of the rectangular tray, wherein said projecting edge engages with the engagement means on the ridge to support said insert in said housing.

6. The cosmetic case according to claim 4, wherein said ridge further comprises a side facing the insert, which side is slanted.

7. The cosmetic case according to claim 4, further comprising:

a) an additional elastic element being disposed on a front wall of the housing;

b) an additional recess being disposed between the inner base of the housing and the additional elastic element on the front wall;

c) an additional notch being disposed at a base of the ridge on a side opposite to said notch;

d) an additional insert being in the form of a rectangular tray and having a base;

e) a first projection being disposed on the exterior of the additional insert on a side facing the additional notch, and being disposed at the base of the additional insert, whereby said first projection on said additional insert engages with the additional notch when the additional insert is inserted into the housing, and said additional elastic element presses the first projection on the additional insert into the notch; and f) a second projection being disposed on the exterior of the additional insert on a side facing the additional recess, and being disposed at the base of the additional insert, whereby said second projection on the additional insert engages with the additional recess and below a point at which the additional elastic element presses against the additional insert when the additional insert is inserted into the housing.

8. The cosmetic case according to claim 7, wherein both sides of said ridge are slanted.

* * * * *

UNITED STATES PATENT AND TRADEMARK OFFICE

CERTIFICATE OF CORRECTION

PATENT NO. : 5,373,862

DATED : December 20, 1994

INVENTOR(S) : Longin Blachut

It is certified that error appears in the above-indentified patent and that said Letters Patent is hereby corrected as shown below:

| Column | Line | |
|---|---|---|
| 1 | 13 | Change "Cosmetic case" to --cosmetic case-- |
| 2 | 55 | Change "projection" to --projection 9--. |

Signed and Sealed this

Eighteenth Day of April, 1995

Bruce Lehman

*Attest:*

BRUCE LEHMAN

*Commissioner of Patents and Trademarks*

*Attesting Officer*